US005275753A

United States Patent [19]

de Buzzaccarini et al.

[11] Patent Number: 5,275,753

[45] Date of Patent: Jan. 4, 1994

[54] STABILIZED ALKALINE LIQUID DETERGENT COMPOSITIONS CONTAINING ENZYME AND PEROXYGEN BLEACH

[75] Inventors: Francesco de Buzzaccarini, Ixelles; Christiaan A. J. K. Thoen, Haasdonk; Jean-Pol Boutique, Genbloux, all of Belgium

[73] Assignee: The Procter & Gamble Company, Cincinnati, Ohio

[21] Appl. No.: 725,420

[22] Filed: Jun. 28, 1991

Related U.S. Application Data

[63] Continuation of Ser. No. 462,672, Jan. 9, 1990, abandoned.

[30] Foreign Application Priority Data

Jan. 10, 1989 [GB] United Kingdom ..... 8900525

[51] Int. Cl.[5] ..... C11D 3/386; C11D 3/395; C11D 3/02

[52] U.S. Cl. ..... 252/95; 252/99; 252/174.12; 252/DIG. 12; 252/186.3

[58] Field of Search ..... 252/95, 174.12, DIG.

[56] References Cited

U.S. PATENT DOCUMENTS

| | | | |
|---|---|---|---|
| 3,676,374 | 7/1972 | Zaki et al. | 252/551 |
| 4,071,462 | 1/1978 | Matsunaga et al. | 252/99 |
| 4,240,920 | 12/1982 | DeLuque | 252/99 |
| 4,287,082 | 9/1981 | Tolfo et al. | 252/174.12 |
| 4,305,837 | 12/1981 | Kaminsky et al. | 252/174.12 |
| 4,318,818 | 3/1982 | Letton et al. | 252/174.12 |
| 4,381,247 | 4/1983 | Nakagawa et al. | 252/95 |
| 4,421,668 | 12/1983 | Cox | 252/174.12 |
| 4,443,355 | 4/1984 | Murata | 252/174.12 |
| 4,532,064 | 7/1985 | Boskamp | 252/105 |
| 4,568,477 | 2/1986 | Oakes | 252/99 |

FOREIGN PATENT DOCUMENTS

| | | |
|---|---|---|
| 3511515 | 10/1985 | Denmark . |
| 0037184 | 10/1981 | European Pat. Off. . |
| 0086511 | 8/1983 | European Pat. Off. . |
| 0111964 | 6/1984 | European Pat. Off. . |
| 2579615 | 10/1986 | France . |
| 01006097 | 1/1989 | Japan . |
| 2158838A | 11/1985 | United Kingdom . |
| 2173224 | 10/1986 | United Kingdom . |

OTHER PUBLICATIONS

Pending U.S. patent application 462,674, Thoen, filed Jan. 9, 1990.

J. Duqua and B. Simon, "Crystallization of Sodium Perborate from Aqueous Solutions", Journal of Crystal Growth 44 (1978), pp. 265–286.

*Primary Examiner*—Paul Lieberman
*Assistant Examiner*—Kery A. Fries
*Attorney, Agent, or Firm*—Ken K. Patel; Ronald L. Hemingway; Jacobus C. Rasser

[57] ABSTRACT

Stabilization systems for high pH, aqueous liquid detergent compositions containing detergent enzyme and peroxygen bleaches are disclosed.

The detergent compositions contain magnesium salts as an enzyme stabilizing system.

10 Claims, No Drawings

STABILIZED ALKALINE LIQUID DETERGENT COMPOSITIONS CONTAINING ENZYME AND PEROXYGEN BLEACH

This is a file wrapper continuation application of U.S. patent application Ser. No. 07/462,672, filed Jan. 9, 1990, now abandoned.

TECHNICAL FIELD

The present invention relates to a stabilization system for detergent enzymes. More particularly, it relates to a stabilization system for detergent enzymes in an aqueous liquid detergent composition having a pH of at least 8.5, which further contains a peroxygen bleach.

BACKGROUND OF THE INVENTION

EP 88-201009.3 discloses aqueous liquid detergent compositions containing a peroxygen bleach. The compositions are designed to limit the amount of available oxygen in solution. Enzyme-containing compositions are disclosed. The patent document does not disclose stabilization systems for the enzymes. At the time of filing of the present patent application, no publication of EP 88-201009.3 has taken place.

EP 28 865 discloses a stabilization system for enzymes in a liquid detergent composition comprising formic acid or a salt thereof and calcium ions. The disclosed composition have a pH of from 6.5 to 8.5.

U.S. Pat. No. 4,381,247 discloses a dry, powdered, enzyme containing, bleaching compositions; stabilizers including magnesium sulphate are disclosed.

Liquid detergent compositions containing enzymes and stabilization agents including magnesium salts are disclosed in U.S. Pat. Nos. 3,676,374; 4,443,355 and GB-A-2,794,826

SUMMARY OF THE INVENTION

The present invention relates to aqueous liquid detergent compositions having a pH of at least 8.5, containing an organic surfactant, a peroxygen compound, a detergent enzyme, characterized in that it further contains, as an enzyme stabilizing system, from 10 ppm to 10 000 ppm of magnesium ions.

Preferred compositions also contain a certain amount of chelants. Such compositions contain higher levels of magnesium ions, from 100 ppm to 10 000 ppm.

The compositions according to the invention have a pH at room temperature of at least 8.5, more preferably at least 9.0, most preferably at least 9.5. The peroxygen compound preferably is a perborate, most preferably perborate tetrahydrate.

Preferred compositions contain a water-miscible organic solvent such as ethanol. This reduces the solubility of any dispersed peroxygen compound, resulting in a low level of available oxygen in the liquid phase that is controlled to be under 0.5%, preferably below 0.1%.

Suitable detergent enzymes include detergent proteases, detergent amylases, detergent lipases and detergent cellulases. Preferred detergent compositions herein are those that contain a detergent protease, preferably a high alkaline protease, from 0.01% to 5% on 8 KNPU/g basis, most preferably from 0.05% to 2.5%

DETAILED DESCRIPTION OF THE INVENTION

In spite of their rapidly growing popularity, liquid detergent compositions do not fully match the performance profile of high quality granular detergent; this is a reason why liquid detergent compositions containing detergent enzymes have appeared over the past years.

It is well known that detergent enzymes in liquid compositions are subject to deactivation, such mechanism involving autohydrolysis of the enzyme and being referred to as autolysis.

Hence, several enzyme stabilization systems have been proposed to reduce such autolysis, including calcium salts and magnesium salts. It can be noticed that these compositions have a pH lower than 8.5 and it is recognized that, in such conditions, calcium has a much greater stabilizing effect than magnesium in reducing autolysis.

In order to improve the performances of these liquid detergent compositions, it has now become desirable to use compositions which further contain peroxygen bleaches. It is still well known that peroxygen bleach containing compositions at higher pH, i.e. above 8.5, perform better in the wash.

However, these compositions are very stressing to detergent enzymes and autolysis becomes more of a problem as the pH of the compositions increases. It has been found that calcium salts are no longer efficient in stabilizing the detergent enzyme in such pH conditions, they even inhibit the enzyme's performance upon storage.

It has now surprisingly been found that magnesium ions provide an efficient stabilizing system for the enzyme, in bleach containing, high pH compositions when added in an amount ranging from 10 ppm to 10 000 ppm.

Any magnesium source capable of supplying free (water soluble) magnesium ions can be used. Preferred, for reasons of availability, are magnesium sulfate, magnesium chloride, magnesium acetate and magnesium formate, most preferred are magnesium acetate and magnesium chloride. Such compounds can be added in the composition as such. As an alternative the magnesium source may be "premixed" with the enzyme, hereinafter described, before being introduced into the composition. Said premix may also be evaporated or lyophilised so as to obtain solid particles. Such particles may then be coated with e.g. silicone oil.

The liquid detergent compositions herein all contain from 5% to 60% by weight of the liquid detergent composition, preferably from 15% to 40% of an organic surface-active agent selected from nonionic, anionic, cationic, and zwitterionic surface-active agents and mixtures thereof.

Synthetic anionic surfactants can be represented by the general formula $R_1SO_3M$ wherein $R_1$ represents a hydrocarbon group selected from the group consisting of straight or branched alkyl radicals containing from about 8 to about 24 carbon atoms and alkyl phenyl radicals containing from about 9 to about 15 carbon atoms in the alkyl group. M is a salt-forming cation which is typically selected from the group consisting of sodium, potassium, ammonium, and mixtures thereof.

A preferred synthetic anionic surfactant is a water-soluble salt of an alkylbenzene sulfonic acid containing from 9 to 15 carbon atoms in the alkyl group. Another preferred synthetic anionic surfactant is a water-soluble salt of an alkyl sulfate or an alkyl polyethoxylate ether sulfate wherein the alkyl group contains from about 8 to about 24, preferably from about 10 to about 18 carbon atoms and there are from about 1 to about 20, preferably from 1 to about 12 ethoxy groups. Other suitable anionic surfactants are disclosed in U.S. Pat. No. 4,170,565, Flesher et al., issued Oct. 9, 1979.

The nonionic surfactants are conventionally produced by condensing ethylene oxide with a hydrocarbon having a reactive hydrogen atom, e.g. a hydroxyl, carboxyl, or amino group, in the presence of an acidic of basic catalyst, and include compounds having the general formula $RA(CH_2CH_2O)_nH$ wherein R represents the hydrophobic moiety, A represents the group carrying the reactive hydrogen atom and n represents the average number of ethylene oxide moieties. R typically contains from about 8 to 22 carbon atoms. They can also be formed by the condensation of propylene oxide with a lower molecular weight compound. n usually varies from about 2 to about 24.

The hydrophobic moiety of the nonionic compound is preferably a primary or secondary, straight or branched, aliphatic alcohol having from about 8 to 24, preferably from about 12 to about 20 carbon atoms. A more complete disclosure of suitable nonionic surfactants can be found in U.S. Pat. No. 4,111,855. Mixtures of nonionic surfactants can be desirable.

Suitable cationic surfactants include quaternary ammonium compounds of the formula $R_1R_2R_3R_4N^+$ where $R_1$, $R_2$, and $R_3$ are methyl groups and $R_4$ is a $C_{12}$–$C_{15}$ alkyl group, or where $R_1$ is an ethyl or hydroxy ethyl group, $R_2$ and $R_3$ are methyl groups and $R_4$ is a $C_{12}$–$C_{15}$ alkyl group.

Zwitterionic surfactants include derivatives of aliphatic quaternary ammonium, phosphonium, and sulphonium compounds in which the aliphatic moiety can be a straight or branched chain and wherein one of the aliphatic substituents contains from about 8 to about 24 carbon atoms and another substituent contains, at least, an anionic water-solubilizing group. Particularly preferred zwitterionic materials are the ethoxylated ammonium sulfonates and sulfates disclosed in U.S. Pat. Nos. 3,925,262, Laughlin et al., issued Dec. 9, 1975 and 3,929,678, Laughlin et al., issued Dec. 30, 1975.

Semi-polar nonionic surfactants include water-soluble amine oxides containing one alkyl or hydroxy alkyl moiety of from about 8 to about 28 carbon atoms and two moieties selected from the group consisting of alkyl groups and hydroxy alkyl groups, containing from 1 to about 3 carbon atoms which can optionally be joined into ring structures.

Suitable anionic synthetic surface-active salts are selected from the group of sulfonates and sulfates. The like anionic detergents are well-known in the detergent arts and have found wide-spread application in commercial detergents. Preferred anionic synthetic water-soluble sulfonate of sulfate salts have in their molecular structure an alkyl radical containing from about 8 to about 22 carbon atoms.

Examples of such preferred anionic surfactant salts are the reaction products obtained by sulfating $C_8$–$C_{18}$ fatty alcohols derived from tallow and coconut oil; alkylbenzene sulfonates wherein the alkyl group contains from about 9 to 15 carbon atoms; sodium alkylglyceryl ether sulfonates; ether sulfates of fatty alcohols derived from tallow and coconut oils; coconut fatty acid monoglyceride sulfates and sulfonates; and water-soluble salts of paraffin sulfonates having from about 8 to about 22 carbon atoms in the alkyl chain. Sulfonated olefin surfactants as more fully described in e.g. U.S. Pat. No. 3,332,880 can also be used. The neutralizing cation for the anionic synthetic sulfonates and/or sulfates is represented by conventional cations which are widely used in detergent technology such as sodium and potassium.

A particularly preferred anionic synthetic surfactant component herein is represented by the water-soluble salts of an alkylbenzene sulfonic acid, preferably sodium alkylbenzene sulfonates having from about 10 to 13 carbon atoms in the alkyl group.

A preferred class of nonionic ethoxylates is represented by the condensation product of a fatty alcohol having from 12 to 15 carbon atoms and from about 2 to 10, preferably 3 to 7 moles of ethylene oxide per mole of fatty alcohol. Suitable species of this class of ethoxylates include: the condensation product of $C_{12}$–$C_{15}$ oxo-alcohols and 7 moles of ethylene oxide per mole of alcohol; the condensation product of narrow cut $C_{14}$–$C_{15}$ oxo-alcohols and 7 or 9 moles of ethylene oxide per mole of fatty(oxo)alcohol; the condensation product of a narrow cut $C_{12}$–$C_{13}$ fatty(oxo)alcohol and 6,5 moles of ethylene oxide per mole of fatty alcohol; and the condensation products of a $C_{10}$–$C_{14}$ coconut fatty alcohol with a degree of ethoxylation (moles EO/mole fatty alcohol) in the range from 5 to 8. The fatty oxo alcohols while mainly linear can have, depending upon the processing conditions and raw material olefins, a certain degree of branching, particularly short chain such as methyl branching.

A degree of branching in the range from 15% to 50% (weight %) is frequently found in commercial oxo alcohols.

Preferred nonionic ethoxylated components can also be represented by a mixture of 2 separately ethoxylated nonionic surfactants having a different degree of ethoxylation. For example, the nonionic ethoxylate surfactant containing from 3 to 7 moles of ethylene oxide per mole of hydrophobic moiety and a second ethoxylated species having from 8 to 14 moles of ethylene oxide per mole of hydrophobic moiety. A preferred nonionic ethoxylated mixture contains a lower ethoxylate which is the condensation product of a $C_{12}$–$C_{15}$ oxo-alcohol, with up to 50% (wt) branching, and from about 3 to 7 moles of ethylene oxide per mole of fatty oxo-alcohol, and a higher ethoxylate which is the condensation product of a $C_{16}$–$C_{19}$ oxo-alcohol with more than 50% (wt) branching and from about 8 to 14 moles of ethylene oxide per mole of branched oxo-alcohol.

Suitable bleaches in the present compositions are solid, water-soluble peroxygen compounds. Preferred compounds include perborates, persulfates, peroxydisulfates, perphosphates and the crystalline peroxyhydrates formed by reacting hydrogen peroxyde with sodium carbonate or urea. Preferred peroxygen bleach compounds are sodium perborate monohydrate and sodium perborate tetrahydrate and sodium percarbonate. Perborate bleaches in the present composition can be in the form of small particles i.e. from 0.1 to 20 micrometers, said particles having been formed by in situ crystallization of the perborate.

The term "in situ crystallization" relates to processes whereby perborate particles are formed from larger particles or from solution, in the presence of the water-/anionic surfactant/detergent builder matrix. This term therefore encompasses processes involving chemical reactions, as when sodium perborate is formed by reacting stoichiometric amounts of hydrogen peroxide and sodium metaborate or borax. It also encompasses processes involving dissolution and recrystallization, as in the dissolution of perborate monohydrate and subsequent formation of perborate tetrahydrate. Recrystallization may also take place by allowing perborate monohydrate to take up crystal water, whereby the monohydrate directly recrystallizes into the tetrahydrate, without dissolution step.

In one embodiment of the invention, a perborate compound, e.g., sodium perborate monohydrate, is added to an aqueous liquid comprising the anionic surfactant and the detergent builder. The resulting slurry is stirred. During this stirring the perborate compound undergoes a process of dissolution/recrystallization. Due to the presence of the anionic surfactant and the detergent builder this dissolution/recrystallization process results in particles having the desired particle diameter.

As the monohydrate is more susceptible to recrystallization, the monohydrate is preferred for this embodiment of the invention. Particle diameters herein are weight average particle diameters, unless otherwise specified. For reasons of physical stability it is preferred that the particle size distribution is relatively narrow; i.e., it is preferred that less than 10% (wt) has a particle diameter greater than 10 micrometers.

In a second embodiment of the invention the perborate compound is formed in situ by chemical reaction. For example, sodium metaborate is added to an aqueous liquid comprising the anionic surfactant and the detergent builder. Then a stoichiometric amount of hydrogen peroxide is added while stirring. Stirring is continued until the reaction is complete.

Instead of metaborate, other borate compounds, including e.g., borax and boric acid can be used. If borax is used as the boron compound, a stoichiometric amount of a base, e.g. sodium hydroxide, is added to ensure reaction of the borax to metaborate. The process then proceeds as described hereinabove for metaborate conversion. Instead of hydrogen peroxide, other peroxides may be used (e.g., sodium peroxide), as known in the art.

Preferred liquid detergent compositions contain, in addition to water, a water-miscible organic solvent. The solvent reduces the solubility of perborate in the liquid phase and thereby enhances the chemical stability of the composition.

It is not necessary that the organic solvent be fully miscible with water, provided that enough of the solvent mixes with the water of the composition to affect the solubility of the perborate compound in the liquid phase.

The water-miscible organic solvent must, of course be compatible with the perborate compound at the pH that is used. Therefore, polyalcohols having vicinal hydroxy groups (e.g. 1,2-propanediol and glycerol) are less desirable.

Examples of suitable water-miscible organic solvents include the lower aliphatic monoalcohols, and ethers of diethylene glycol and lower monoaliphatic monoalcohols. Preferred solvents are ethanol, iso-propanol, 1-methoxy, 2-propanol, ethyldiglycolether and butyldiglycolether.

The compositions according to the invention also contain detergent enzymes; suitable enzymes include the detergent proteases, amylases, lipases, cellulases and mixtures thereof. Preferred enzymes are high alkaline proteases e.g. Maxacal (R) and Savinase (R). Silicone-coated enzymes, as described in EP-A-0238216 can also be used.

Preferred compositions herein optionally contain as a builder a fatty acid component. Preferably, however, the amount of fatty acid is less than 5% by weight of the composition, more preferably less than 4%. Preferred saturated fatty acids have from 10 to 16, more preferably 12 to 14 carbon atoms. Preferred unsaturated fatty acids are oleic acid and palmitoleic acid.

Preferred compositions contain an inorganic or organic builder. Examples of inorganic builders include the phosphorous-based builders, e.g., sodium tripolyphosphate, sodium pyrophosphate, and aluminosilicates (zeolites).

Examples of organic builders are represented by polyacids such as citric acid, nitrilotriacetic acid, and mixtures of tartrate monosuccinate with tartrate disuccinate. Preferred builders for use herein are citric acid and alk(en)yl-substituted succinic acid compounds, wherein alk(en)yl contains from 10 to 16 carbon atoms. An example of this group of compounds is dodecenyl succinic acid. Polymeric carboxylate builders inclusive of polyacrylates, polyhydroxy acrylates and polyacrylates/-polymaleates copolymers can also be used.

The compositions herein can contain a series of further optional ingredients which are mostly used in additive levels, usually below about 5%. Examples of the like additives include: suds regulants, opacifiers, agents to improve the machine compatibility in relation to enamel-coated surfaces, bactericides, dyes, perfumes, brighteners and the like.

The preferred liquid compositions herein further contain chelants at a level from 0.05% to 5%.

These chelants include polyaminocarboxylates such as ethylenediaminotetracetic acid, diethylenetriaminopentacetic acid, ethylenediamino disuccinic acid or the water-soluble alkali metals thereof. Other additives include organo-phosphonic acids; particularly preferred are ethylenediamino tetramethylenephosphonic acid, hexamethylenediamino tetramethylenephosphonic acid, diethylenetriamino pentamethylenephosphonic acid and aminotrimethylenephosphonic acid.

When such chelants are present in the composition, the amount of magnesium salts should be in the range of from 100 ppm to 10 000 ppm.

Bleach stabilizers such as ascorbic acid, dipicolinic acid, sodium stannates and 8-hydroxyquinoline can also be included in these compositions, at levels from 0.01% to 1%.

The beneficial utilization of the claimed compositions under various usage conditions can require the utilization of a suds regulant. While generally all detergent suds regulants can be utilized preferred for use herein are alkylated polysiloxanes such as dimethylpolysiloxane also frequently termed silicones. The silicones are frequently used in a level not exceeding 1.5%, most preferably from 0.1% to 1.0%.

also be desirable to utilize opacifiers in as much as they contribute to create a uniform appearance of the concentrated liquid detergent compositions. Examples of suitable opacifiers include: polystyrene commercially known as LYTRON 621 manufactured by MONSANTO CHEMICAL CORPORATION. The opacifiers are frequently used in an amount from 0.3% to 1.5%.

The liquid detergent compositions of this invention can further comprise an agent to improve the washing machine compatibility, particularly in relation to enamel-coated surfaces.

It can further be desirable to add from 0.1% to 5% of known antiredeposition and/or compatibilizing agents.

Examples of the like additives include: sodium carboxymethylcellulose; hydroxy-$C_{1-6}$-alkylcellulose; polycarboxylic homo- or copolymeric ingredients, such as: polymaleic acid; a copolymer of maleic anhydride and methylvinylether in a molar ratio of 2:1 to 1:2; and a copolymer of an ethylenically unsaturated monocarboxylic acid monomer, having not more than 5, preferably 3 or 4 carbon atoms, for example (meth)-acrylic acid, and an ethylenically unsaturated dicarboxylic acid monomer having not more than 6, preferably 4 carbon atoms, whereby the molar ratio of the monomers is in the range from 1:4 to 4:1, said copolymer being described in more detail in European Patent Application 0 066 915, filed May 17, 1982.

The compositions according to the invention have a pH at room temperature of at least 8.5, more preferably at least 9.0, most preferably at least 9.5.

The following examples illustrate the invention and facilitate its understanding.

Liquid detergent compositions were prepared by mixing the listed ingredients in the stated proportions.

The pH of the following formulations is in the range of from 9.5 to 10.5 at room temperature.

| INGREDIENTS | COMPOSITION (by weight %) | | | | | | | |
|---|---|---|---|---|---|---|---|---|
| | I | II | III | IV | V | VI | VII | VIII |
| Water | 28.0 | 26.0 | 34.0 | 34.0 | 30.0 | 41.0 | 41.0 | 36.0 |
| Ethanol | 13.0 | 13.0 | 8.0 | 8.0 | 8.0 | 8.0 | 8.0 | 8.0 |
| Linear dodecylbenzene sulfonic acid | 9.0 | 9.0 | 9.0 | 9.0 | 9.0 | 9.0 | 9.0 | 9.0 |
| Sodium cocoyl sulfate | 1.0 | 1.0 | | | 1.0 | | | |
| Condensation product of 1 mole of $C_{13}$-$C_{15}$ oxoalcohol and 7 moles of ethylene oxide | 7.0 | 7.0 | | | | | 7.0 | |
| Condensation product of 1 mole of $C_{13}$-$C_{15}$ oxoalcohol and 5 moles of ethylene oxide | | | 7.0 | 7.0 | 7.0 | 7.0 | | 7.0 |
| $C_{12}$-$C_{14}$ (2hydroxyethyl)dimethyl ammonium chloride | | | 0.5 | 0.5 | 0.5 | | 0.5 | 0.5 |
| Dodecenyl succinic acid | 12.5 | | | | | 10.0 | | |
| Dodecenyl-tetradecenyl succinic acid | | | | 10.0 | | | 10.0 | |
| Coconut fatty acid | | 15.0 | | | | | | |
| TMS/TDS* | | | 12.5 | | | | | |
| Sodium tripolyphosphate | | | | | 15.0 | | | |
| Zeolite | | | | | | | | 15.0 |
| Citric acid | 1.0 | 1.0 | 3.0 | 3.0 | 2.8 | 2.8 | 3.0 | 2.8 |
| Oleic acid | 3.0 | 3.0 | | | | | | |
| Diethylene triamine pentamethylene phosphonic acid | 0.7 | 0.7 | 0.7 | | | | | |
| Hexamethylene diaminetetra (methylene phosphonic acid) | | | | 0.6 | 0.6 | | | 0.7 |
| Sodium perborate monohydrate | 14.5 | 14.0 | 14.5 | 15.0 | 14.5 | 14.5 | 14.5 | 14.5 |
| Protease 8 KNPU/g | 0.5 | 0.5 | | | | | | |
| Protease 16 KNPU/g | | | 0.3 | 0.3 | 0.3 | 0.3 | 0.3 | 0.3 |
| Amylase | 0.2 | 0.2 | | | | | | 0.2 |
| Sodium formate | 1.0 | 1.5 | | | 1.5 | 1.0 | | |
| Sodium acetate | | | 2.5 | | 2.5 | | | |
| Adipic acid | | | | 2.5 | | | | |
| Magnesium acetate tetrahydrate | 1.7 | 1.7 | | | 1.7 | 0.1 | | |
| Magnesium chloride hexahydrate | | | 1.7 | 3.4 | | | 0.1 | 0.7 |
| Sodium hydroxide | 5.0 | 5.0 | 5.0 | 5.0 | 5.0 | 5.0 | 5.0 | 5.0 |
| Perfume and minors | | | | balance | | | | |

*(80:20) mixture of tartrate monosuccinate/tartrate disuccinate

What is claimed is:

1. An aqueous liquid detergent composition having a pH of 9.0, comprising from 5% to 60% of an organic surfactant, a peroxygen compound from 0.01% to 5% on 8 KNPU/g basis of a detergent protease enzyme, and an enzyme stabilizing system containing from 100 ppm to 10,000 ppm of magnesium ions.

2. An aqueous liquid detergent composition according to claim 1, characterized in that it contains from 100 ppm to 4 000 ppm of magnesium ions.

3. An aqueous liquid detergent composition according to claim 1 wherein the magnesium ions are incorporated as magnesium acetate or magnesium chloride.

4. An aqueous liquid detergent composition according to claim 1, wherein the pH is at least 9.5.

5. An aqueous liquid detergent composition according to claim 1 wherein the peroxygen compound is a perborate.

6. An aqueous liquid detergent composition according to claim 1, wherein the peroxygen compound is a percarbonate.

7. An aqueous liquid detergent composition according to claim 5, further comprising a water miscible organic solvent such that the perborate compound is present as a dispersion of solid particles and the amount of available oxygen in solution is less than 0.5 %.

8. An aqueous liquid detergent composition according to claim 1 wherein the composition further comprises a detergent enzyme selected from the group consisting of detergent amylases, detergent lipases, detergent cellulases, and mixtures thereof.

9. An aqueous liquid detergent composition according to claim 1 wherein the detergent enzyme comprises a high alkaline detergent protease.

10. An aqueous liquid detergent composition according to claim 1 characterized in that it further contains a chelant.

* * * * *